US009770115B1

(12) United States Patent
Shikhelman et al.

(10) Patent No.: US 9,770,115 B1
(45) Date of Patent: Sep. 26, 2017

(54) WRIST SUPPORT CUSHION

(71) Applicants: Grigoriy Shikhelman, Culver City, CA (US); Aleksandr Artamonov, Culver City, CA (US)

(72) Inventors: Grigoriy Shikhelman, Culver City, CA (US); Aleksandr Artamonov, Culver City, CA (US)

( * ) Notice: Subject to any disclaimer, the term of this patent is extended or adjusted under 35 U.S.C. 154(b) by 0 days.

(21) Appl. No.: 15/417,125

(22) Filed: Jan. 26, 2017

Related U.S. Application Data

(60) Provisional application No. 62/290,351, filed on Feb. 2, 2016.

(51) Int. Cl.

| | |
|---|---|
| ***B41J 11/62*** | (2006.01) |
| ***A47C 31/00*** | (2006.01) |
| ***A47B 97/00*** | (2006.01) |
| ***A47C 16/00*** | (2006.01) |

(52) U.S. Cl.
CPC ..... *A47C 31/007* (2013.01); *A47B 97/00* (2013.01); *A47C 16/00* (2013.01)

(58) Field of Classification Search
CPC ... A47B 21/0371; A47B 97/00; A47C 31/007; A47C 16/00
USPC ..... 248/118, 918; 400/715; 607/99
See application file for complete search history.

(56) References Cited

U.S. PATENT DOCUMENTS 1,585,482 A 5/1926 Fraser
5,125,606 A * 6/1992 Cassano ..... A47B 21/0371 248/118
5,421,543 A 6/1995 Rossman
5,445,349 A * 8/1995 Hart ..... A47B 21/0371 248/118
5,562,270 A 10/1996 Montague
5,568,907 A 10/1996 Wolfe
5,884,879 A 3/1999 Gruenenfelder
5,980,143 A 11/1999 Bayer
6,048,325 A 4/2000 Kendall
6,089,516 A * 7/2000 Yates ..... G06F 3/039 248/118
6,131,862 A 10/2000 Gruenenfelder
6,283,419 B1 * 9/2001 Silkworth ..... A47B 21/0371 248/118.5
6,336,614 B1 1/2002 Kwitek
6,694,553 B1 * 2/2004 Yates ..... A47B 21/0371 5/646
7,183,523 B2 * 2/2007 Lu ..... A47B 21/0371 219/521

(Continued)

*Primary Examiner* — Todd M Epps
(74) *Attorney, Agent, or Firm* — Quickpatents, LLC; Kevin Prince

(57) ABSTRACT

A cushion for supporting a wrist of a user on a flat surface comprises an elongated flexible enclosure that has an outside surface and that defines an internal volume within. The internal volume contains a filling that includes a resilient padding material and at least one silver wire. Preferably the padding material includes horse hair. The enclosure preferably includes a cotton fabric material made with a warp-faced twill weave, or other tight weave, such that the padding material is unable to penetrate the fabric material. In use, upon absorption of sweat form the user's wrist through the enclosure and into the filling, or by washing of the cushion in water, the at least one silver wire produces silver ions as an anti-bacterial agent on the enclosure and within the internal volume.

12 Claims, 3 Drawing Sheets

(56) References Cited

U.S. PATENT DOCUMENTS

| | | | | |
|---|---|---|---|---|
| 9,301,600 | B1 * | 4/2016 | Duggal | A47B 21/0371 |
| 2003/0209641 | A1 | 11/2003 | Cooke | |
| 2005/0029412 | A1 | 2/2005 | Pearce | |
| 2007/0001066 | A1 | 1/2007 | Lane | |
| 2007/0204402 | A1 | 9/2007 | Harris | |
| 2008/0142672 | A1 | 6/2008 | Tran | |
| 2009/0083908 | A1 | 4/2009 | Fry | |
| 2010/0090953 | A1 | 4/2010 | Loomis | |
| 2010/0166832 | A1 | 7/2010 | Ingle | |
| 2010/0230556 | A1 | 9/2010 | Mayer | |
| 2011/0309212 | A1 | 12/2011 | Guerrieri | |
| 2015/0167211 | A1 | 6/2015 | Hiatt | |

* cited by examiner

WRIST SUPPORT CUSHION

CROSS-REFERENCE TO RELATED APPLICATIONS

This application claims the benefit of U.S. Provisional Patent Application 62/290,351, filed on Feb. 2, 2016, and incorporated herein by reference.

STATEMENT REGARDING FEDERALLY SPONSORED RESEARCH AND DEVELOPMENT

Not Applicable.

FIELD OF THE INVENTION

This invention relates to wrist rests, and more particularly to an anti-bacterial wrist rest.

DISCUSSION OF RELATED ART

Carpal tunnel syndrome is a painful condition caused by compression of a key nerve in the wrist, a condition often aggravated by improper posture of the hands and wrists when using a computer keyboard or mouse. Wrist rests of the prior art include various types of pads and pillows, but none provide a holistic approach with optimal benefits, such as optimal cushioning of the wrists in an elevated position above a flat support surface for the keyboard, inhibiting bacteria and other germ growth, and the like.

Therefore, there is a need for a device that elevates the wrists while typing on a computer keyboard or mouse at an optimal orientation for preventing compression of nerves within the wrist and thereby helping to prevent carpal tunnel syndrome. Such a needed invention would provide a cushion that is washable and that includes anti-bacterial properties for inhibiting the growth of bacteria. The present invention accomplishes these objectives.

SUMMARY OF THE INVENTION

The present device is a cushion for supporting a wrist of a user on a flat surface. The cushion comprises an elongated flexible enclosure that has an outside surface and that defines an internal volume within. The internal volume contains a filling that includes a resilient padding material and at least one silver wire. Preferably the padding material includes horse hair. The at least one silver wire is preferably a Fine 0.999 silver vertical spiral having rounded ends so that the spiral will not to penetrate the enclosure.

The enclosure preferably includes a cotton fabric material made with a warp-faced twill weave, or other tight weave, such that the padding material is unable to penetrate the fabric material.

In use, upon absorption of sweat form the user's wrist through the enclosure and into the filling, or by washing of the cushion in water, the at least one silver wire produces silver ions as an anti-bacterial agent on the enclosure and within the internal volume.

The present invention is a cushion device that elevates the wrists while typing on a computer keyboard or mouse or using a mouse input device at an optimal orientation for preventing compression of nerves within the wrist and thereby helping to prevent carpal tunnel syndrome. The present invention provides a cushion that is washable and that includes anti-bacterial properties for inhibiting the growth of bacteria. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
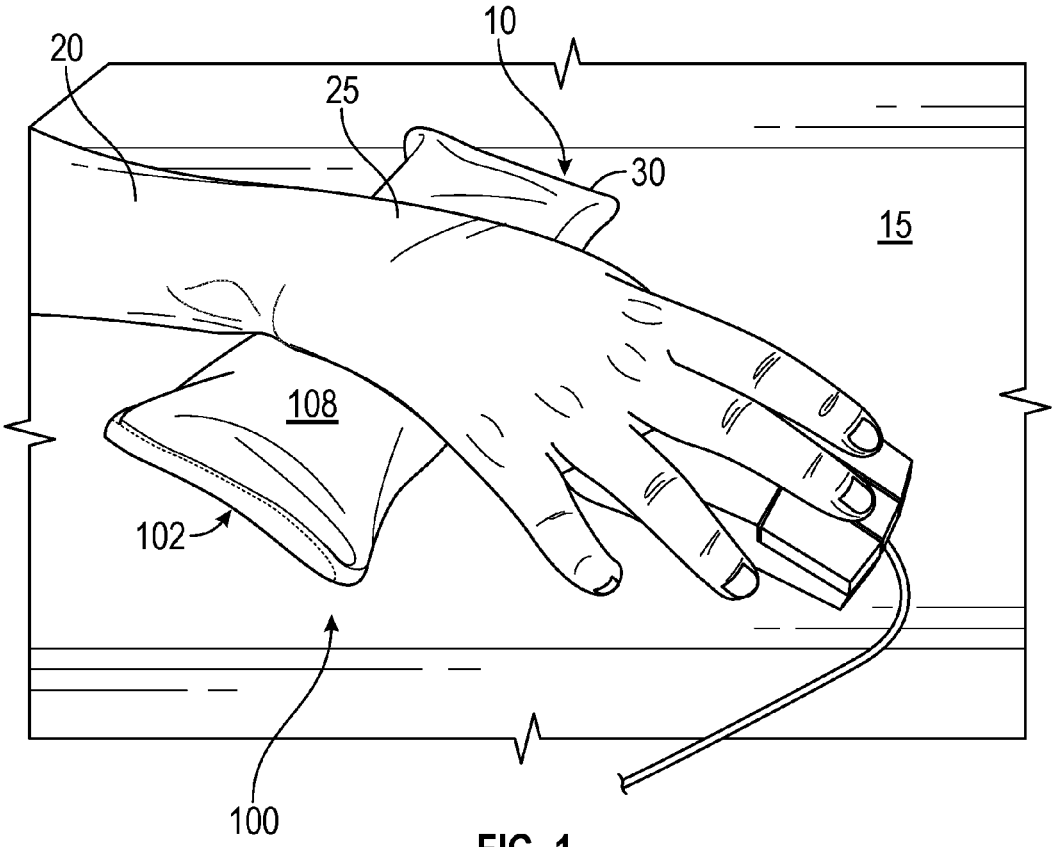
FIG. 1 is a perspective view of a first embodiment of the invention.
Figure 2:
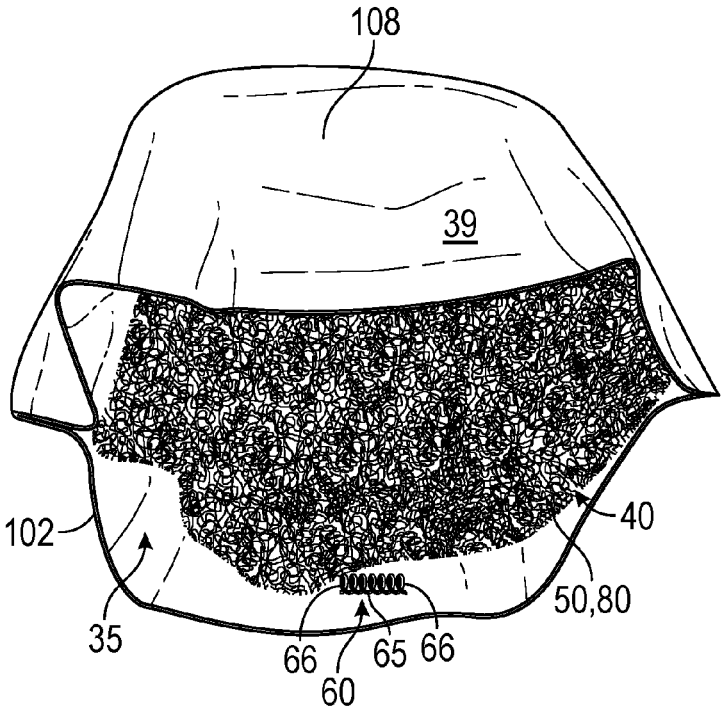
FIG. 2 is a perspective side elevational view of the invention, illustrated with the enclosure open at one end to expose an internal volume that contains a filling.

FIGS. 1 and 2 illustrate a cushion 10 for supporting a wrist 25 of a user 20 on a flat surface 15, such as a desk top or table top. The cushion 10 comprises an elongated flexible enclosure 30 that has an outside surface 39 and that defines an internal volume 35 within.

Figure 3:
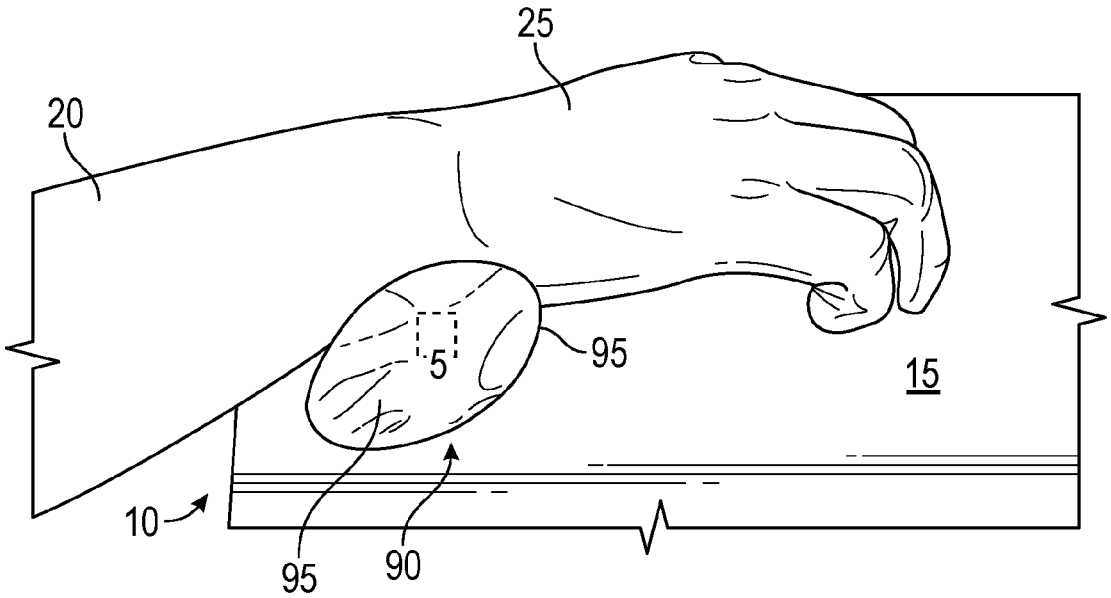
FIG. 3 is a side elevational view of a second embodiment of the invention.
Figure 4:
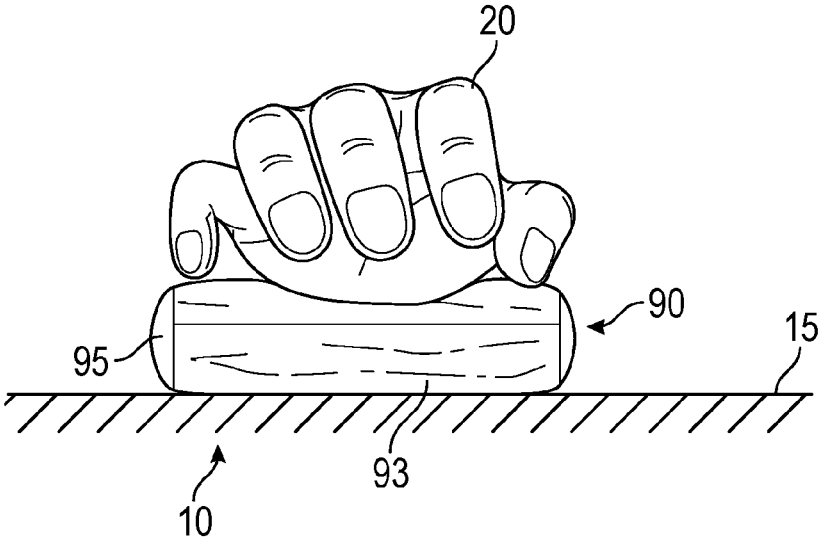
FIG. 4 is a front elevational view thereof.

In one embodiment, the enclosure 30 is a cylinder 90 (FIGS. 3 and 4) having two circular ends 95 sewn to a looped rectangular body 93. Such a cylinder 90 preferably has ends 95 measuring between two and three inches in diameter, the length of the body being between two and five inches, so as to accommodate the average human hand thereon comfortably yet not interfere with other objects on the surface 15.

In an alternate embodiment, the elongated flexible enclosure 30 takes the form of an elongated pillow 100 (FIGS. 1 and 2), having a rectangular top side 108 and a rectangular bottom side 102, each side affixed mutually at corresponding edges thereof. The length of the pillow 100 is preferably between two and five inches, and the width is between one and four inches, and the height is between one-half inch to two inches, also as to accommodate the average human hand thereon comfortably yet not interfere with other objects on the surface 15.

The internal volume 35 contains a filling 40 that includes a resilient padding material 50 and at least one silver wire 60. Preferably the padding material 50 includes horse hair 80, preferably obtained from the manes and tails of horses and ranging in length from eight inches to three feet. The preferred horse hair 80 is coarse, strong, lustrous, and resilient, providing it with a relatively low density. Horse hair 80 obtained from the mane is softest and ranges from 50 to 150 microns in diameter. Horse hair 80 taken from the tail is coarser, has greater resilient, and ranges from 75 to 280 microns in diameter. The preferred horse hair 80 has been treated in a hardening and tempering process, such as that produced by Moosburger Robhaar-Manufactur of Austria (http://www.moosburger-kg.com/).

The ratio between the length and the width of the pillow 100 is between 1.6 and 1.7, and preferably about 1.618 which has been found to, with the horse hair 80 filling the internal volume 35, provide an optimal amount of wrist support while not completely compressing the enclosure 30.

The at least one silver wire 60 is preferably a Fine 0.999 silver vertical spiral 65 (FIG. 2). Preferably such as vertical spiral wire 65 has rounded ends 66 so that the spiral wire 65 will not penetrate the enclosure 30. Such a silver wire 60 acts as an anti-bacterial material to inhibit microbe growth within the enclosure 30, producing silver ions as an anti-bacterial agent both on the enclosure 30 and within the internal volume 35.

Figure 5:
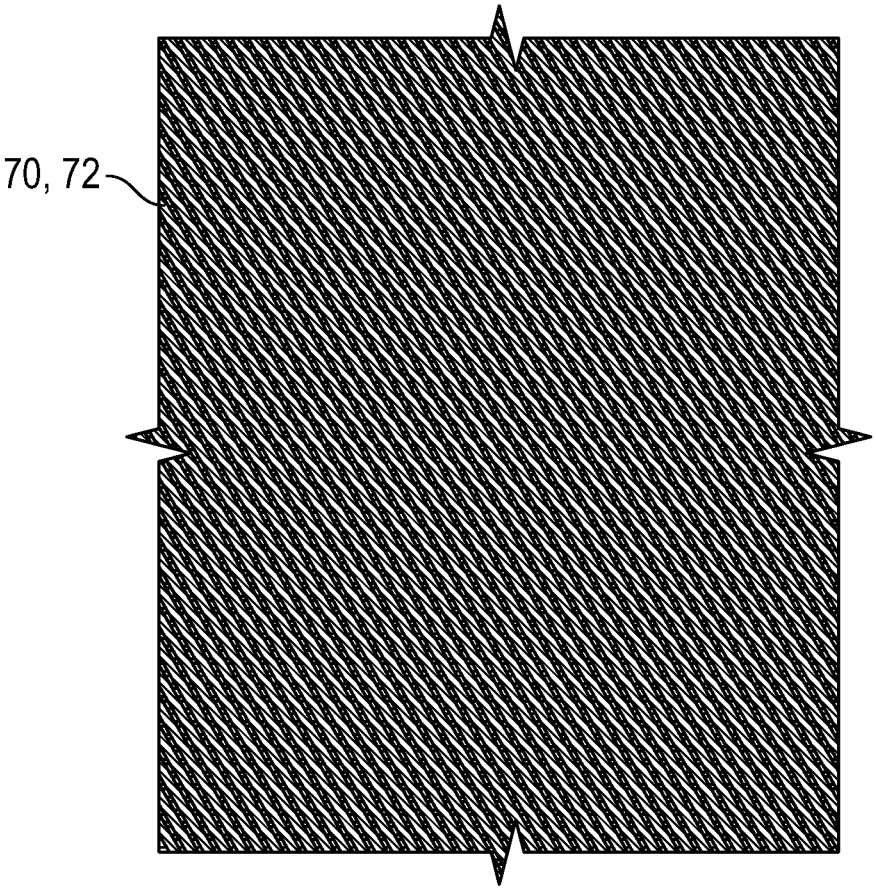
FIG. 5 is an enlarged portion of a fabric enclosure of the invention, taken along 5-5 of FIG. 3.

The enclosure 30 preferably includes a cotton fabric material 70 (FIG. 5) made with a warp-faced twill weave 72, or other tight weave, such that the padding material 50 is unable to penetrate the fabric material 70.

In use, upon absorption of sweat from the user's wrist 25 through the enclosure 30 and into the filling 40, or by washing of the cushion 10 in water, the at least one silver wire 60 produces silver ions as an anti-bacterial agent on the enclosure and 30 within the internal volume 35.

While a particular form of the invention has been illustrated and described, it will be apparent that various modifications can be made without departing from the spirit and scope of the invention. For example, various shapes of the cushion 10 may be utilized as needed, not just the elongated cylinder 90 or the elongated pillow 100 as shown in the drawings. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A cushion for supporting a user's wrist on a flat surface, the cushion comprising:

an elongated flexible enclosure having an outside surface and that defines an internal volume; and a filling including a resilient padding material and at least one silver wire, the filling contained within the internal volume of the enclosure;

whereby upon absorption of sweat from the user's wrist through the enclosure and into the filling, or upon contact with water, the at least one silver wire produces silver ions as an anti-bacterial agent on the enclosure and within the internal volume.

2. The cushion of claim 1 wherein the flexible enclosure includes a cotton fabric material.

3. The cushion of claim 2 wherein the cotton fabric material is made with a warp-faced twill weave.

4. The cushion of claim 3 wherein the resilient padding material includes horse hair, the tight twill weave of the cotton fabric material enclosure preventing the horse hair from traversing the enclosure.

5. The cushion of claim 1 wherein the silver wire is a Fine 0.999 silver vertical spiral.

6. The cushion of claim 1 wherein the elongated flexible enclosure is a cylinder having two circular ends sewn to a looped rectangular body.

7. The cushion of claim 6 wherein a diameter of each circular end is between two and three inches.

8. The cushion of claim 6 wherein a length of the cylinder is between two and five inches.

9. The cushion of claim 1 wherein the elongated flexible enclosure takes a form of an elongated pillow having a rectangular top side and a rectangular bottom side, each side affixed mutually at corresponding edges thereof.

10. The cushion of claim 9 wherein a length of the elongated pillow is between two and five inches, and a width is between one and four inches, and a height is between one-half inch to two inches.

11. A cushion for supporting a user's wrist on a flat surface, the cushion comprising:

an elongated flexible enclosure having an outside surface and that defines an internal volume, the flexible enclosure including a warp-faced twill weave cotton fabric material, the elongated flexible enclosure being a cylinder having two circular ends sewn to a looped rectangular body, a diameter of each circular end being between two and three inches and a length of the cylinder being between two and five inches; and a filling including a resilient padding material that includes horse hair, the tight twill weave of the cotton fabric material enclosure preventing the horse hair from traversing the enclosure, and at least one Fine 0.999 silver wire spiral, the filling contained within the internal volume of the enclosure;

whereby upon absorption of sweat from the user's wrist through the enclosure and into the filling, or upon contact with water, the at least one silver wire produces silver ions as an anti-bacterial agent on the enclosure and within the internal volume.

12. A cushion for supporting a user's wrist on a flat surface, the cushion comprising:

an elongated flexible enclosure having an outside surface and that defines an internal volume, the flexible enclosure including a warp-faced twill weave cotton fabric material, the elongated flexible enclosure taking a form of an elongated pillow having a rectangular top side and a rectangular bottom side, each side being mutually affixed at corresponding edges thereof, a length of the elongated pillow being between two and five inches, and a width being between one and four inches, and a height being between one-half inch to two inches; and a filling including a resilient padding material that includes horse hair, the tight twill weave of the cotton fabric material enclosure preventing the horse hair from traversing the enclosure, and at least one Fine 0.999 silver wire spiral, the filling contained within the internal volume of the enclosure;

whereby upon absorption of sweat from the user's wrist through the enclosure and into the filling, or upon contact with water, the at least one silver wire produces silver ions as an anti-bacterial agent on the enclosure and within the internal volume.

* * * * *